US005165620A

United States Patent [19]

Kampiziones

[11] Patent Number: 5,165,620

[45] Date of Patent: Nov. 24, 1992

[54] EXPANDING ROLL CORE SPINDLE

[76] Inventor: Theodore G. Kampiziones, P.O. Box 670, Florence, S.C. 29501

[21] Appl. No.: 713,528

[22] Filed: Jun. 12, 1991

[51] Int. Cl.[5] ..... B65H 75/24

[52] U.S. Cl. ..... 242/72.1

[58] Field of Search ..... 242/72.1, 72 R, 46.4, 242/68.2, 68.3, 68.4

[56] References Cited

U.S. PATENT DOCUMENTS

| | | | |
|---|---|---|---|
| 533,451 | 2/1895 | Farnsworth | 242/72.1 |
| 1,668,990 | 5/1928 | Tromblay | 242/72.1 |
| 1,907,896 | 5/1933 | Summey | 242/72.1 |
| 1,920,203 | 8/1933 | Larsen . | |
| 2,241,669 | 5/1941 | McConnell | 242/72.1 |
| 3,079,102 | 2/1963 | Douglas . | |
| 3,552,673 | 1/1971 | Evers | 242/72.1 |
| 3,675,866 | 7/1972 | Lemke et al. . | |
| 3,823,892 | 7/1974 | Glaser . | |
| 4,403,938 | 9/1983 | Seach et al. . | |
| 4,643,658 | 2/1987 | Gordon . | |

FOREIGN PATENT DOCUMENTS

| | | | |
|---|---|---|---|
| 873891 | 8/1961 | United Kingdom | 242/72.1 |

*Primary Examiner*—Stanley N. Gilreath
*Attorney, Agent, or Firm*—Jacobson, Price, Holman & Stern

[57] ABSTRACT

A pair of mount rings are mounted upon a tubular body of a roll core spindle in axially spaced relation and have a plurality of elongated spacing members disposed and secured between corresponding peripheral portions of the rings. A conical sleeve wedge is slidably mounted upon the tubular body between the mount rings and a plurality of shoes are mounted between the rings and spaced circumferentially thereabout outwardly of the conical wedge sleeve for movement between radial innermost and radial outermost limit positions, the shoes including grooved rollers journaled therefrom for rolling engagement with the conical wedge sleeve. The tubular body is provided with diametrically opposite radial slots through which an operator extending diametrically of the tubular body has its opposite ends slidingly received and opposite ends of the operator are anchored to the wedge sleeve and force generating structure disposed within the tubular body is operatively connected to the operator for the wedge sleeve and is operable to effect longitudinal shifting of the wedge sleeve along the tubular body.

18 Claims, 4 Drawing Sheets

EXPANDING ROLL CORE SPINDLE

BACKGROUND OF THE INVENTION

1. Field of the Invention

This invention relates to a tubular roll core spindle for supporting the opposite ends of a tubular roll core in a manner such that the core spindle may be rotated at high speed for winding of sheet material thereon at least substantially independent of lateral flexure of any portion of the roll core during the winding process.

A first form of the invention utilizes a pair of expanding chuck assemblies for engagement with and support of opposite end portions of a roll core spaced therealong from the opposite ends thereof and a second form of the invention includes a chuck assembly for mounting within the terminal end portion of a roll core.

2. Description of Related Art

Various different forms of drum spindles, expandable roll cores, expanding mandrels and other apparatus for handling web roll winding shafts heretofore have been provided such as those disclosed in U.S. Pat. Nos.: 1,920,203, 3,079,102, 3,675,886, 3,823,892, 4,403,938 and 4,643,658. However, these previously known devices do not include the overall combination of structural features of the instant invention.

SUMMARY OF THE INVENTION

Mills which produce paper, film, fabric and other similar products utilize machinery which produce the product at high speed and the product is rolled onto a tubular core. This is frequently done at a high rate of speed with pressure on the material to produce a tight roll. As the material is rolled onto the core, the weight of the material and the pressure of the rolling process may cause the core to buckle or to be at least appreciably laterally deflected impairing the rolling process and producing an unevenness in the product being rolled onto the core.

Accordingly, a need exist for a device which may support a core during the rolling process to produce a high concentricity between the material being rolled and the core. Such device must be capable of supporting the core against the pressure applied by the material being wound upon the core during the rolling process. When the rolling process is complete, the device must be readily removable from the core so that the roll product can be removed from the machine and the device may be repositioned within the next core upon which the product is to be wound.

The expanding roll core spindle of the instant invention utilizes a fluid actuated expandable chuck for engaging and internally supporting an associated core during the rolling process and one form of the invention utilizes a pair of chucks actuated by a single double acting fluid cylinder, whereby the pressure exerted by the chucks on the supported roll core is equalized.

The main object of this invention is to provide a tubular core support which will enable high speed winding of sheet material upon a core while the sheet material is under tension.

Another object of this invention is to provide a tubular core support which may be used to at least substantially eliminate lateral flexure of a tubular core during a winding operation, even when the weight of material supported from the core is considerable.

Still another object of this invention is to provide a tubular core support in accordance with the preceding objects and including end structure adapting the core support for mounting from rotary heads.

Another very important object of this invention is to provide a tubular core support including a plurality of expanding chucks spaced therealong and means for expanding the plurality of chucks with equal pressure into engagement with and for support of the opposing tubular core inner surfaces.

A further object of this invention is to provide a tubular core support specifically adapted for mounting from only one rotary head and to be utilized in supporting only the adjacent end of an associated tubular core support.

A final object of this invention to be specifically enumerated herein is to provide a tubular core support in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Referring now more specifically to the drawings the numeral 10 generally designates an expanding roll core spindle for support of a tubular roll core 12 therefrom upon which a flexible web is to be wound in a tensioned state and at high speed in order to form a roll 14 of the web on the core 12.

Figure 1:
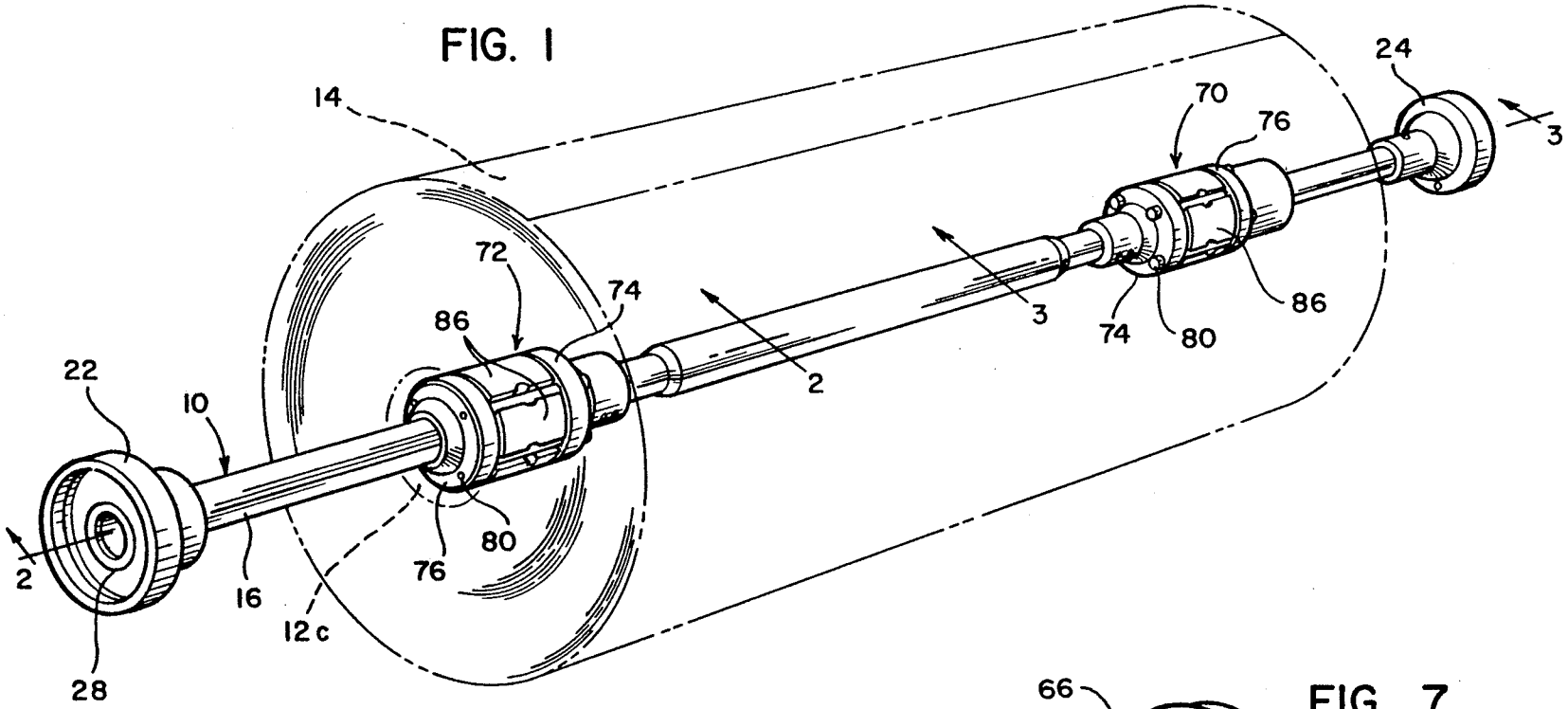
FIG. 1 is a perspective view of a tubular core support constructed in accordance with the present invention and with a tubular core of substantially the shortest length possible mounted thereon illustrated in phantom lines and having a sheet material wound thereabout also illustrated in phantom lines, the tubular core support being capable of supporting a tubular core of approximately 50 percent greater length than that illustrated in phantom lines.
Figure 7:
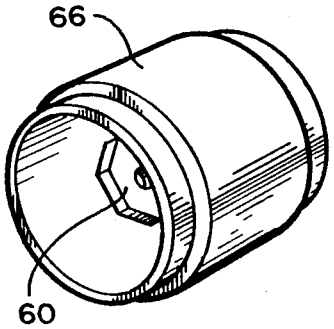
FIG. 7 is an enlarged perspective of one of the wedge cones of the tubular core support with the wedge cone drive bar for connection with the associated fluid cylinder mounted therein.
Figure 8:
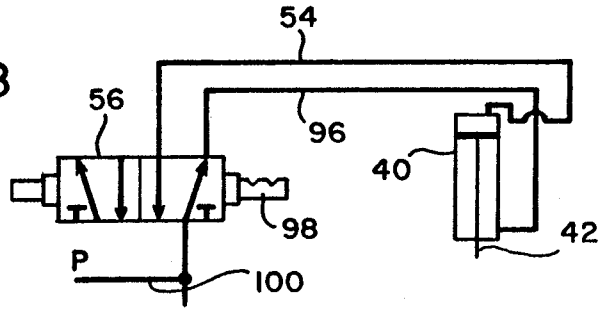
FIG. 8 is a diagrammatic view of the fluid control system for the fluid cylinder of the tubular core support.
Figure 2:
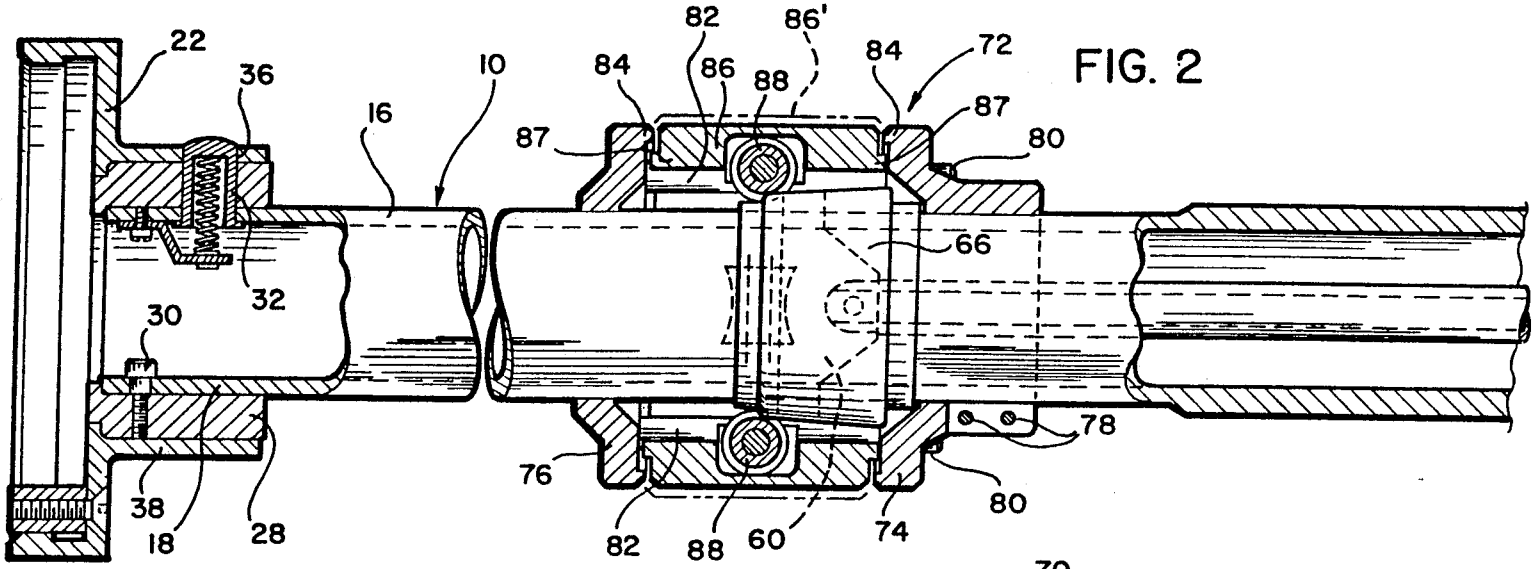
FIG. 2 is a fragmentary enlarged vertical sectional view taken substantially upon the plane indicated by the section line 2—2 of FIG. 1 and with the shoes of the chuck assemblies in retracted positions, portions of the tubular core support being broken away.
Figure 3:
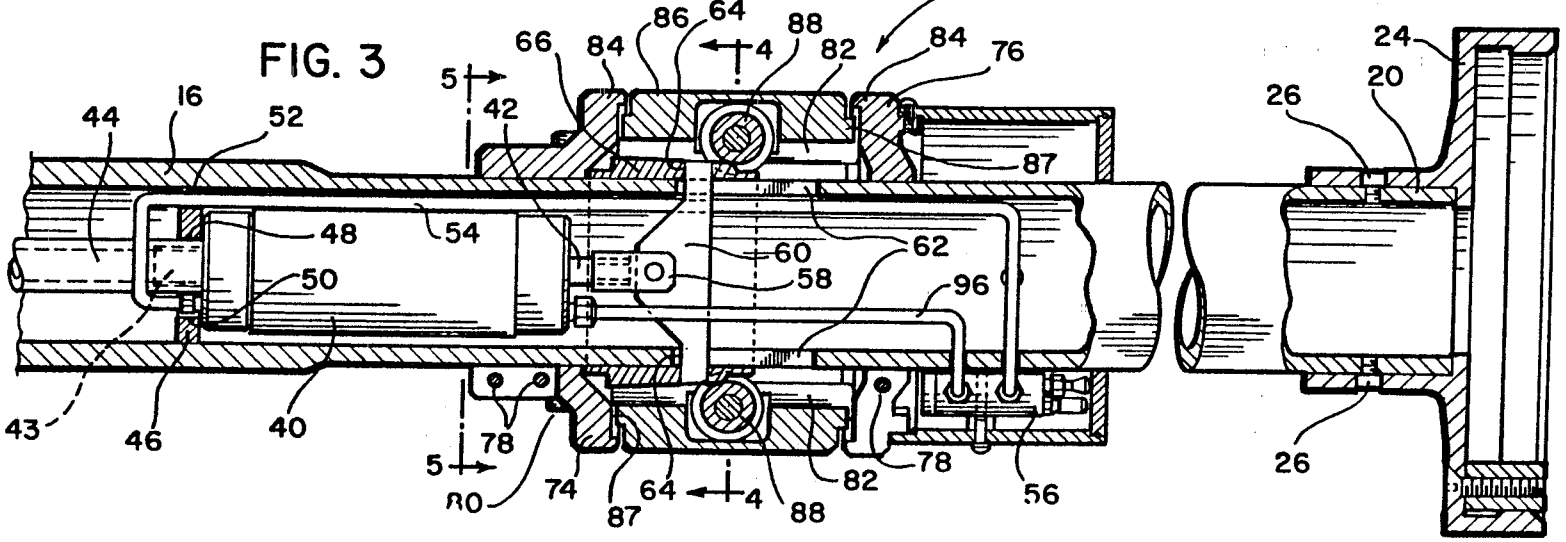
FIG. 3 is an enlarged fragmentary vertical sectional view taken substantially upon the plane indicated by the section line 3—3 of FIG. 1.

As may best be seen from FIGS. 2 and 3 of the drawings, the roll core spindle 10 includes an elongated tubular body 16 having opposite ends 18 and 20 upon which end rights or rings 22 and 24 are removably mounted for mounting the roll core spindle 10 from a winding machine (not shown).

The end right 24 is removably secured to the end 20 through the utilization of suitable fasteners 26 and is adapted to oppose the end of a tubular core such as the core 12 but which is of greater length and extends almost completely between the end rights or rings 22 and 24.

The end right 22 is mounted on the end 18 through the utilization of a tubular adapter 28 secured on the end 18 by a fastener 30 and the end 18 and adapter 28 have a spring biased lock pin 32 operatively associated therewith which is utilized to removably mount the end right or ring 22 upon the adapter 28 carried by the end 18, the lock pin 32 being radially inwardly retractable through a radial bore 36 formed in the cylindrical collar portion 38 of the end right or ring 22. Also, the lock pin 32 additionally serves to retain the tubular adapter 28 on the end 18.

By making the end ring or right 22 readily removable, the expanding roll core spindle 10 may be used in conjunction with a core 12 which is smaller in diameter than the end right 22.

With further reference to FIGS. 2 and 3, a double acting fluid cylinder 40 is mounted within a longitudinal mid-portion of the tubular body 16 and includes an extendable and retractable piston shaft on one end and a mounting shank 43 on the other end to which one end of an operating tube 44 is secured, the last mentioned end of the operating tube 44 being received through a guide bushing 46 disposed within the tubular body 16 having a central opening 48 formed therethrough and a pair of additional openings 50 and 52 formed therein through which the J-shaped end of a fluid pressure line 54 is received, the remote end of the fluid pressure line 54 being connected to a four way spool valve 56.

The piston shaft 42 of the cylinder 40 is connected by a fitting 58 to a diametric operator plate 60 including end portions slidably received in radial slots 62 formed in the body 16 and also received in radial slots 64 formed in a tapered, cylindrical wedge member or sleeve 66 snugly slidably disposed on the adjacent portion of the exterior of the tubular body 16.

A pair of chuck assemblies referred to in general by the reference numerals 70 and 72 are mounted upon the ends 18 and 20 and each chuck assembly includes inner and outer radially split mount rings 74 and 76 tightly clamped about the corresponding tubular body end through the utilization of clamp bolts 78 with each pair of mount rings mounted on the corresponding body end in axially spaced relation and secured together through the utilization of bolts 80 paralleling and spaced about the tubular body 16 and extending through spacing tubes 82 disposed between each pair of rings 74 and 76. The outer peripheries of the rings 74 and 76 include axially extending abutment lips 84 and four chuck shoes 86 are disposed between the four bolts 80 of each chuck assembly inwardly of the lips 84, the shoes 86 each including abutment lips 87 opposing the corresponding lips 84 to define radial outward limit positions of the shoes 86.

Figure 4:
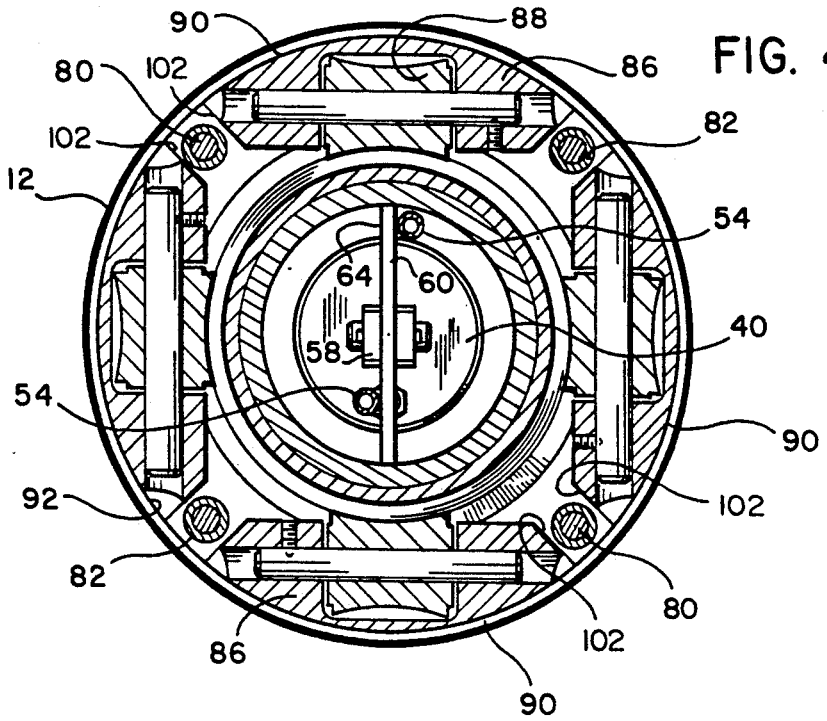
FIG. 4 is an enlarged transverse vertical sectional view taken substantially upon the plane indicated by the section line 4—4 of FIG. 3.
Figure 5:
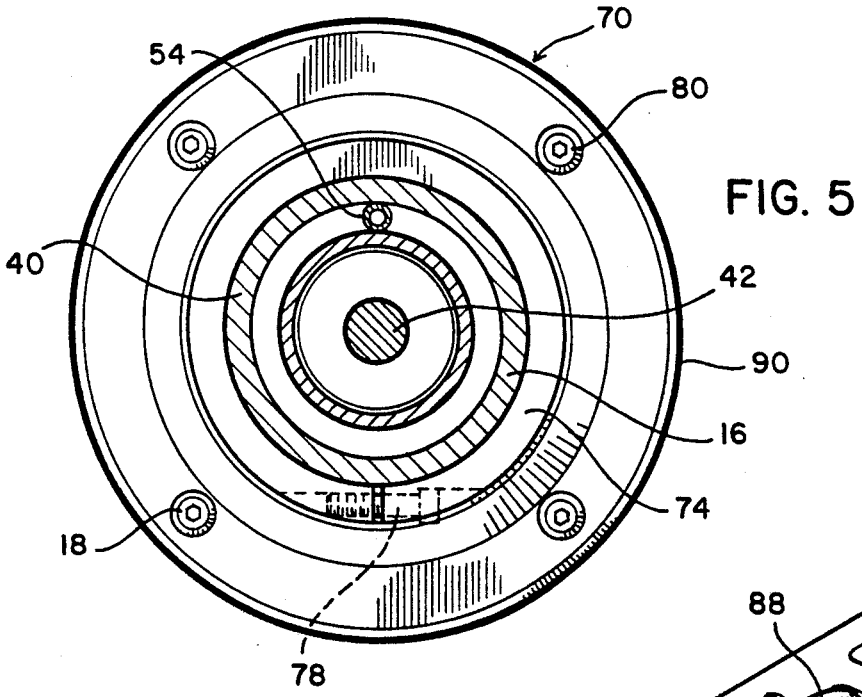
FIG. 5 is an enlarged vertical sectional view taken substantially upon the plane indicated by the section line 5—5 of FIG. 3.

The tapered, cylindrical wedge member 66 of each chuck assembly is disposed between the corresponding mounting rings 74 and 76 thereof and each shoe 86 includes a grooved roller 88 journaled therefrom rollingly engaged with the corresponding cylindrical wedge member 66. The end of the operating tube 44 remote from the cylinder 40 is operatively connected to the operator 60 of the cylindrical wedge member 66 of the chuck assembly 72 and, upon extension of the piston shaft 42 of the cylinder 40 the operators 60 are removed away from each other, thus causing the wedge member 66 to move away from each other and the shoes 86 of the chuck assemblies 70 and 72 to shift outward toward their corresponding outermost limit positions such as that 86 are partial cylindrical in configuration for tight outward expansion into engagement with the opposing inner surface portions 92 of the core 12, see FIG. 4.

A second fluid pressure line 96 extends between the spool valve 56 and the end of the fluid cylinder 40 from which the piston shaft 42 is extendable and operation of the spool valve to axially shift the spool 98 thereof may be carried in any suitable manner, the spool valve being provided with a source of fluid under pressure through a supply line 100.

In the invention disclosed, air under pressure is supplied through the supply line 100 and the spool valve 56 is operative to vent air from the supply lines 54 and 96 when air under pressure is supplied to the lines 96 and 54, respectively. If, however, the cylinder 40 is to be actuated by hydraulic pressure, the spool 56 will not vent return fluid to the ambient atmosphere, but to an oil reservoir from which oil is supplied to the supply line 100.

The chuck assemblies 70 and 72 are spaced along the tubular body 16 from the remote ends thereof in order that the core 12 may be evenly supported throughout its length. Further, inasmuch as the fluid cylinder 40 is free to shift back and forth longitudinally of the body 16, the fluid under pressure supplied to the fluid cylinder 40 applies equal axial thrust on the wedge members 66.

Also, the ends of the shoes 86 are beveled as at 102 for abutting engagement with the tubes 82 to prevent shifting of the shoes 86 about the periphery of the associated chuck assembly and to properly center the shoes 86 when they return from extended position to retracted positions.

Figure 9:
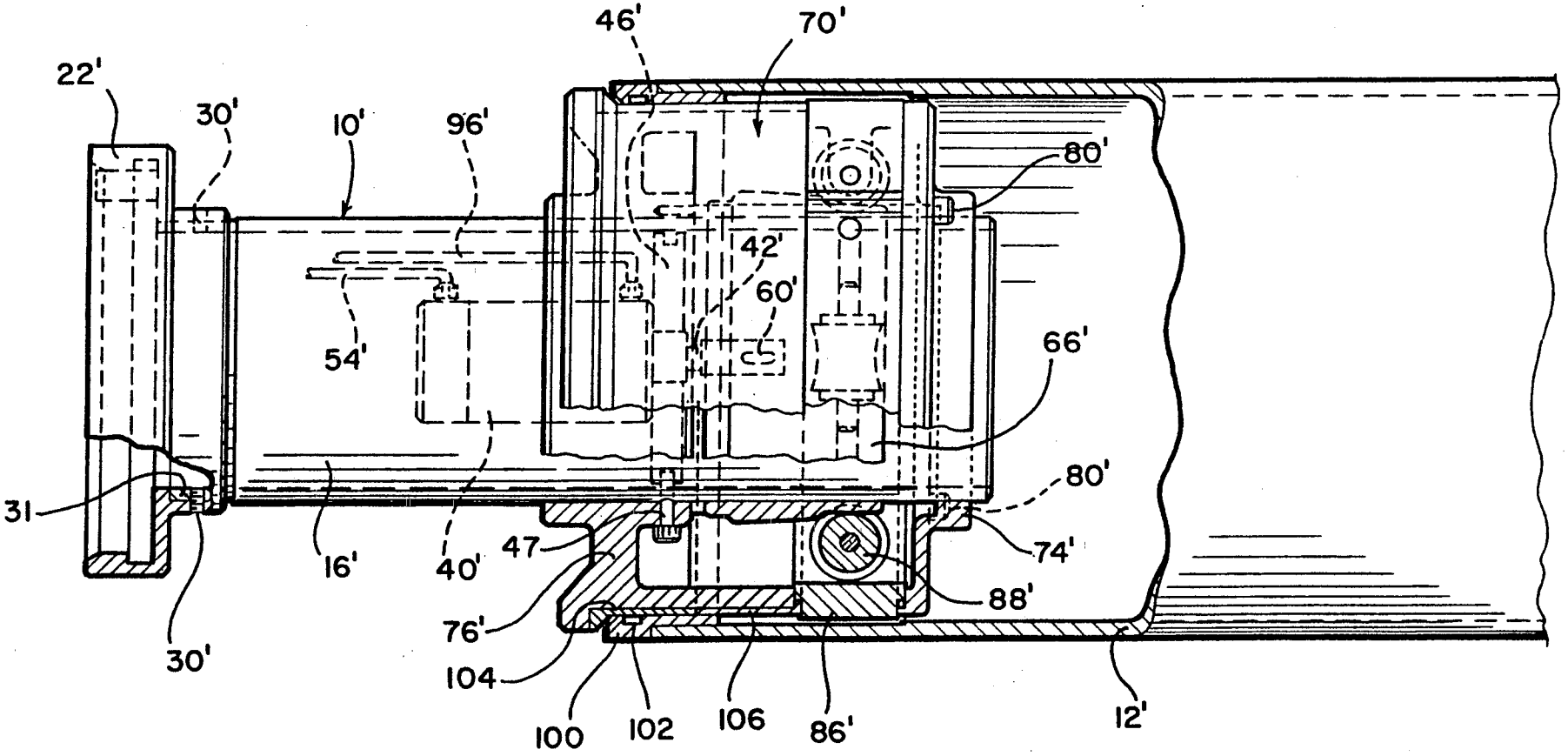
FIG. 9 is a side elevational view of a modified form of tubular core support adapted for supporting one or both ends of a relatively short tubular core.

With attention now invited more specifically to FIG. 9 of the drawings, there may be seen a roll core spindle end referred to in general by the reference numeral 10'. The roll core spindle end 10' includes a tubular body 16' and an end ring or right 22' mounted thereon through the utilization of fasteners 30', the end ring 22' being mounted on a terminal end 31 of the tubular body 16.

The opposite end of the tubular body 16' has a pair of radially split inner and outer mounting rings 74' and 76' mounted thereon in axially spaced relation and having a plurality of fasteners 80' secured therebetween extending through spacing tubes corresponding to the spacing tubes 82. In addition, the tubular body 16' has a mounting ring 46' secured therein through the utilization of a fastener 47 and one end of a fluid cylinder 40' is supported from the mounting ring 46' and includes a pair of fluid lines 54' and 96' corresponding to the lines 54 or 96 connected thereto. The piston shaft 42' is connected to an operator 60' corresponding to the operator 60 and the operator 60' is connected to a tubular wedge member 66' corresponding to the wedge member 66. A plurality of arcuate shoes 86' having rollers 88' journaled therefrom are spaced about the outer peripheral portions of the mounting rings 74' and 76' between adjacent pairs of fasteners 80' and the corresponding spacing tubes.

Figure 6:
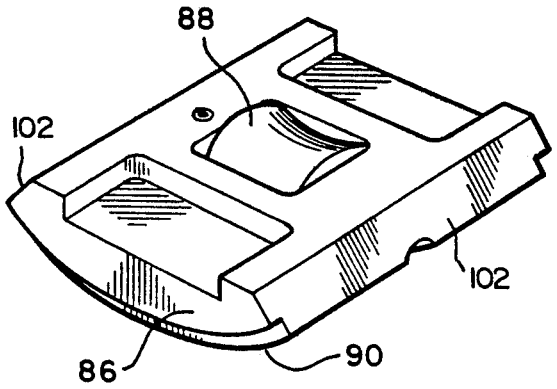
FIG. 6 is a perspective view of one of the shoes incorporated in the tubular core support.

Accordingly, it may be seen that the chuck assembly 70' illustrated in FIG. 6 functions in substantially in the same manner as the chuck assembly 70 in that axial shifting of the tubular wedge member 66' will cause the shoes 86' to be displaced outwardly and tightly engage the internal surfaces of the corresponding end of the core 12'. Of course, the other end of the core 12' also may be supported by a roll core spindle end corresponding to the roll core spindle end 10' and the fluid under pressure supplied to both cylinders 40' may be supplied thereto from the same source of fluid under pressure and through a single spool valve such as the spool valve 56, whereby the fluid pressure supplied to the two cylinders 40' will be equal in pressure.

The core 12' is constructed of aluminum and the end thereof in which the chuck 70' is disposed has a steel ring 100 press fitted therein including an internal groove 102 by which mechanical means may be engaged with the core 12' for handling the same. In addition, an aluminum pipe 104 is disposed about the aluminum mounting ring or hub 76' to provide a wear surface to be engaged by the steel ring 100. Further, an aluminum spacer sleeve 106 is provided and is disposed about the spacing tubes of the chuck 70' corresponding the spacing tubes 82 of the chuck 72, the shoes 86' therefore being disposed between the aluminum spacer sleeve 106 and the mounting ring or hub 74'. Of course, the shoes 86' include abutment lips corresponding to the abutment lips 88 and the mounting ring or hub 74' includes an abutment lip corresponding to the abutment lip 84 and the end of the aluminum spacer sleeve 106 adjacent the shoes 86' comprises the other abutment lip for the shoes 86'.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An expanding roll core spindle including an elongated tubular body having opposite ends adapted for driven rotary support from a winding machine, a fluid cylinder lengthwise slidably disposed within a longitudinal central portion of said body, a pair of expanding chuck assemblies mounted from said tubular body on the exterior thereof intermediate said central portion and said opposite ends, said chuck assemblies each including a plurality of circumferentially spaced shoes loosely guidingly supported therefrom for radial shifting relative to said tubular body for movement between innermost and outermost limit positions and including outwardly facing surfaces for abutting engagement with and support of opposing inner surface portions of a tubular winding core through which said tubular body extends, wedge means shiftably supported from said body exteriorly thereof at each chuck assembly inwardly of the corresponding shoes and for guided shifting longitudinally of said body, said wedge means and shoes including coacting means engagable with each other, upon shifting of said wedge means in opposite directions longitudinally of said body, to radially outwardly shift said shoes relative to said body, said fluid cylinder including an elongated double acting cylinder portion and an elongated piston portion extendable and retractable relative to one end of said cylinder portion, motion connecting means connection said one end of said cylinder to one of said wedge means and said piston portion, to the other of said wedge means, and fluid pressure supply means operatively connected to said cylinder for selectively actuating said cylinder to extend and retract said piston portion relative to said cylinder portion.

2. The spindle of claim 1 wherein each of said chuck assemblies includes a pair of mount rings mounted from said body for rotation therewith in axially spaced relation and from and between which said shoes are guidingly mounted for radial shifting, a plurality of elongated spacing members lengthwise disposed between each pair of mount rings and spaced about the peripheries thereof exteriorly of said tubular body, said shoes each being disposed between a pair of adjacent peripherally spaced spacing members whereby the latter serve to prevent displacement of said shoes about said tubular body relative to said spacing members.

3. The spindle of claim 1 wherein each of said spacing members comprises a tubular member, an elongated fastener means extending through each of said tubular members and anchored relative to the corresponding mount rings.

4. The spindle of claim 3 wherein each of said shoes is elongated in a direction extending circumferentially about said mount rings and includes beveled opposite end faces opposing the adjacent tubular members for abutting engagement therewith, said beveled end faces also serving to center said shoes circumferentially of said chuck assemblies when said shoes are displaced generally radially inwardly from their outermost limit positions.

5. The spindle of claim 4 wherein said shoes and mount rings include opposing partially cylindrical surfaces engagable with each other to define the outermost limit positions of said shoes.

6. The spindle of claim 1 wherein said wedge means comprises a conical wedge member slidably mounted on the exterior of said tubular body, each of said shoes including a grooved roller rollingly engaged with said conical wedge.

7. The claim of claim 6 wherein each of said chuck assemblies includes a pair of mount rings mounted from said body for rotation therewith in axially spaced relation and from and between which said shoes are guidingly mounted for radial shifting, a plurality of elongated spacing members disposed between each pair of mount rings and spaced about the peripheries thereof exteriorly of said tubular body, said shoes each being disposed between a pair of adjacent peripherally spaced spacing members whereby the latter serve to prevent displacement of said shoes about said tubular body relative to said spacing members.

8. The spindle of claim 7 wherein said shoes and mount rings include opposing partial cylindrical surfaces engagable with each other to define the outermost limit positions of said shoes.

9. The spindle of claim 8 wherein each of said spacing members comprises a tubular member, an elongated fastener means extending through each of said tubular members and anchored relative to the corresponding mount rings.

10. The spindle of claim 9 wherein each of said shoes is elongated in a direction extending circumferentially about said mount rings and includes beveled opposite end faces opposing the adjacent tubular members for abutting engagement therewith, said beveled end faces also serving to center said shoes circumferentially of said chuck assemblies when said shoes are displaced generally radially inwardly from their outermost limit positions.

11. A chuck assembly for supporting a tubular core end, said chuck assembly including a elongated tubular body having opposite first and second ends, at least said first end including support means for support from a rotatable spindle, at least one tube core end supporting chuck supported from said tubular body spaced from said first end for snug telescopic engagement in a first end of a tubular core, said chuck including a pair of axially spaced mount rings mounted on said body in axially spaced relation therealong, a plurality of circumferentially spaced shoes loosely guidingly supported from and between said mount rings for guided radial shifting relative to said tubular body and including radially outwardly facing surfaces for abutting engagement with and support of opposing inner surface portions of a tubular core end disposed over said supporting chuck, wedge means shiftably supported from said body exteriorly thereof and inwardly of said shoes for guided shifting longitudinally of said body, said wedge means and shoes including coacting means engagable with each other, upon shifting of said wedge means in one direction longitudinally of said tubular body, to radially outwardly shift said shoes relative to said body, a plurality of spacing members spaced about said body exteriorly thereof and disposed and connected between said mount rings, said shoes each being disposed between a pair of circumferentially adjacent spacing members.

12. The chuck assembly of claim 11 wherein each of said spacing members comprises a tubular member, an elongated fastener means extending through each of said tubular members and anchored relative to the corresponding mount rings.

13. The chuck assembly of claim 12 wherein each of said shoes is elongated in a direction extending circumferentially about said mount rings and includes beveled opposite end faces opposing the adjacent tubular members for abutting engagement therewith, said beveled end faces also serving to center said shoes circumferentially of said chuck assemblies when said shoes are displaced generally radially inwardly from their outermost limit positions.

14. The chuck assembly of claim 11 wherein said shoes and mount rings include opposing partial cylindrical surfaces engagable with each other to define the outermost limit positions of said shoes.

15. The chuck assembly of claim 14 wherein said wedge means comprises a conical wedge member slidably mounted on the exterior of said tubular body, each of said shoes including a grooved roller rollingly engaged with said conical wedge.

16. A chuck assembly including a tubular body, a pair of mount rings mounted on said tubular body in axially spaced relation thereon, a conical wedge sleeve slidably mounted on said tubular body between said mount rings, a plurality of circumferentially spaced shoes guidingly supported from said mount rings for radial shifting relative to said tubular body and including radially outwardly facing surfaces for abutting engagement with and support of opposing inner surface portions of a tubular member disposed over said chuck assembly, said shoes each including a grooved roller journaled therefrom rollingly engaged with said conical wedge sleeve, a plurality of elongated spacing members extending and secured between said mount rings and spaced circumferentially about said tubular body, said shoes each being disposed between peripherally adjacent spacing members, said shoes and mount rings including opposing surface portions abuttingly engagable with each other defining radial outermost limit positions of said shoes.

17. The chuck assembly of claim 16 wherein each of said spacing members comprises a tubular member, an elongated fastener means extending through each of said tubular members and anchored relative to the corresponding mount rings.

18. The chuck assembly of claim 17 wherein each of said shoes is elongated in a direction extending circumferentially about said mount rings and includes beveled opposite end faces opposing the adjacent tubular members for abutting engagement therewith, said beveled end faces also serving to center said shoes circumferentially of said chuck assemblies when said shoes are displaced generally radially inwardly from their outermost limit positions.

* * * * *